US007797881B2

(12) United States Patent
Loitherstein

(10) Patent No.: US 7,797,881 B2
(45) Date of Patent: Sep. 21, 2010

(54) GARAGE DOOR CONTROL SYSTEM

(76) Inventor: Joel S. Loitherstein, 18 Rome Way, Ashland, MA (US) 01721

( * ) Notice: Subject to any disclaimer, the term of this patent is extended or adjusted under 35 U.S.C. 154(b) by 243 days.

(21) Appl. No.: 11/425,745

(22) Filed: Jun. 22, 2006

(65) Prior Publication Data

US 2007/0294946 A1 Dec. 27, 2007

Related U.S. Application Data

(60) Provisional application No. 60/692,723, filed on Jun. 22, 2005.

(51) Int. Cl.
*E05F 15/20* (2006.01)

(52) U.S. Cl. ..... 49/25; 49/26; 49/28; 340/932.2

(58) Field of Classification Search ..... 49/25, 49/26, 28; 340/943, 932.2, 917
See application file for complete search history.

(56) References Cited

U.S. PATENT DOCUMENTS 3,716,833 A * 2/1973 Roth ..... 340/904
4,284,971 A * 8/1981 Lowry et al. ..... 340/904
4,916,429 A * 4/1990 Hicks et al. ..... 340/436
5,011,358 A * 4/1991 Andersen et al. ..... 414/273
5,173,692 A * 12/1992 Shapiro et al. ..... 340/943
5,357,183 A * 10/1994 Lin ..... 318/468
5,389,912 A * 2/1995 Arvin ..... 340/435
5,565,843 A * 10/1996 Meyvis ..... 340/691.6
5,710,553 A * 1/1998 Soares ..... 340/903
5,828,320 A * 10/1998 Buck ..... 340/942
5,886,648 A * 3/1999 McElroy et al. ..... 340/943
6,002,332 A * 12/1999 King ..... 340/545.1
6,172,604 B1 * 1/2001 Heillman et al. ..... 340/463
6,611,205 B2 * 8/2003 Guthrie et al. ..... 340/539.1
6,769,440 B2 * 8/2004 Jones et al. ..... 134/57 R
6,915,832 B2 * 7/2005 Stern, Jr. ..... 160/205
7,038,409 B1 * 5/2006 Mullet ..... 318/280
7,135,957 B2 * 11/2006 Wilson ..... 340/5.61
7,332,999 B2 * 2/2008 Fitzgibbon ..... 340/5.71
2005/0184854 A1 * 8/2005 Mullet et al. ..... 340/5.22
2006/0254104 A1 * 11/2006 Hipple et al. ..... 40/617
2007/0120656 A1 * 5/2007 Nakanishi et al. ..... 340/435

* cited by examiner

*Primary Examiner*—Jerry Redman
(74) *Attorney, Agent, or Firm*—Brian M. Dingman; Mirick, O'Connell, DeMallie & Lougee, LLP

(57) ABSTRACT

A garage door control system for a garage door that is adapted to be lifted by a garage door opener. The system has a motion sensor or electric eye sensor located at least in part proximate the garage door, for sensing an object located on top of a vehicle approaching the garage and projecting higher than is safe to enter the garage, and a cutoff switch that at least temporarily prevents the garage door opener from opening the garage door when the sensor senses an object located on top of a vehicle approaching the garage and projecting higher than is safe to enter the garage.

5 Claims, 2 Drawing Sheets

GARAGE DOOR CONTROL SYSTEM

CROSS REFERENCE TO RELATED APPLICATION

The application claims priority of a Provisional application by the same inventor and having the same title, Ser. No. 60/692,723, filed on Jun. 22, 2005, which is incorporated herein by reference.

FIELD OF THE INVENTION

This invention relates to a garage door control system and methods for preventing damage to equipment or gear mounted on the top of vehicles, to oversized vehicles in general, and to the garage door and the door frame.

BACKGROUND OF THE INVENTION

It is quite common to see vehicles on which various equipment and gear, such as bicycles, canoes, kayaks, storage accessories, and even furniture, are mounted to transport the equipment and gear from one location to another. Problems arise when the drivers of the vehicles forget that the gear is mounted on the roof of the vehicle, particularly after many hours of driving, or overestimate the height or width of a garage entrance. In such instances, when the top or sides of the gear exceeds the boundaries of the garage entrance, the gear, the garage, and the vehicle may be damaged. In worst case scenarios the occupants of the vehicles may also be injured.

Although automated garage door control systems provide systems for preventing a garage door from closing when a person or object is within the frame of the garage door entrance, there are not any systems available that prevent the door from opening after the garage door opener is triggered.

SUMMARY OF THE INVENTION

It is therefore a primary object of this invention to provide garage door control systems and methods that prevent a garage door from opening when one or more dimensions of a vehicle approaching the garage exceed certain parameters, for example if a roof-mounted object projects higher than the safe height to enter the garage without hitting the door.

This invention features a garage door control system for a garage door that is adapted to be lifted by a garage door opener, comprising means for sensing an object located on top of a vehicle approaching the garage and projecting higher than is safe to enter the garage, and means, responsive to the means for sensing, for at least temporarily preventing the garage door from opening. The means for sensing may comprise a motion sensor. The motion sensor may be mounted to the garage just above the garage door. The means for sensing may comprise a sender and a receiver. The receiver may be located on the garage proximate the garage door at the maximum operating height. The sender may be located remotely from the receiver to create a sense zone between the sender and receiver, such that a vehicle approaching the garage passes underneath the sense zone.

The means for preventing the garage door from opening may comprise a switch to prevent the garage door opener from working. The means for preventing the garage door from opening may inhibit the garage door opener from working for only a predetermined time.

Also featured in the invention is a garage door control system for a garage door that is adapted to be lifted by a garage door opener, comprising a motion sensor or electric eye sensor located at least in part proximate the garage door, for sensing an object located on top of a vehicle approaching the garage and projecting higher than is safe to enter the garage, and a cutoff switch that at least temporarily prevents the garage door opener from opening the garage door when the sensor senses an object located on top of a vehicle approaching the garage and projecting higher than is safe to enter the garage.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The invention features a garage door control system that prevents a garage door from opening when the system senses that an object in a predetermined zone exceeds one or more predetermined parameters.

Figure 1:
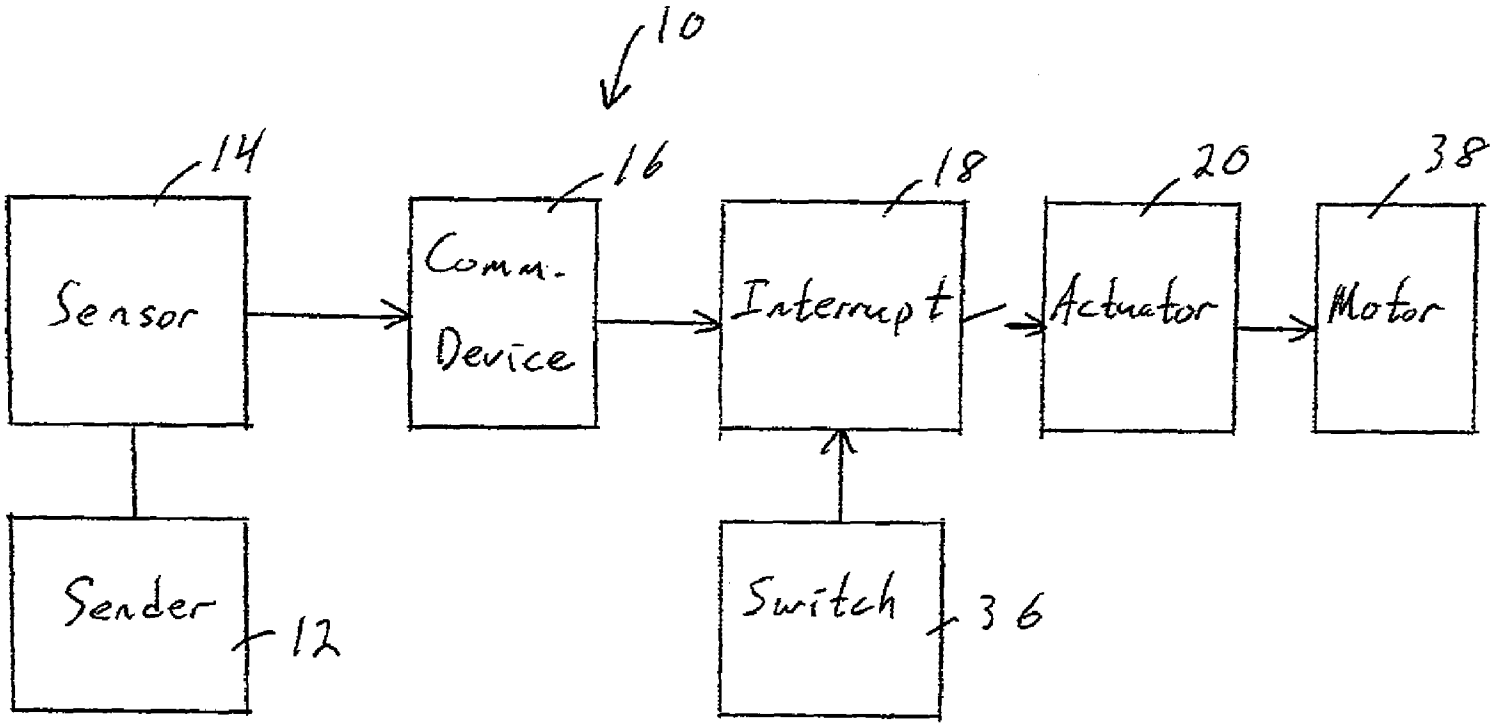
FIG. 1 is a schematic view of a preferred embodiment of the control system of the invention.
Figure 2:
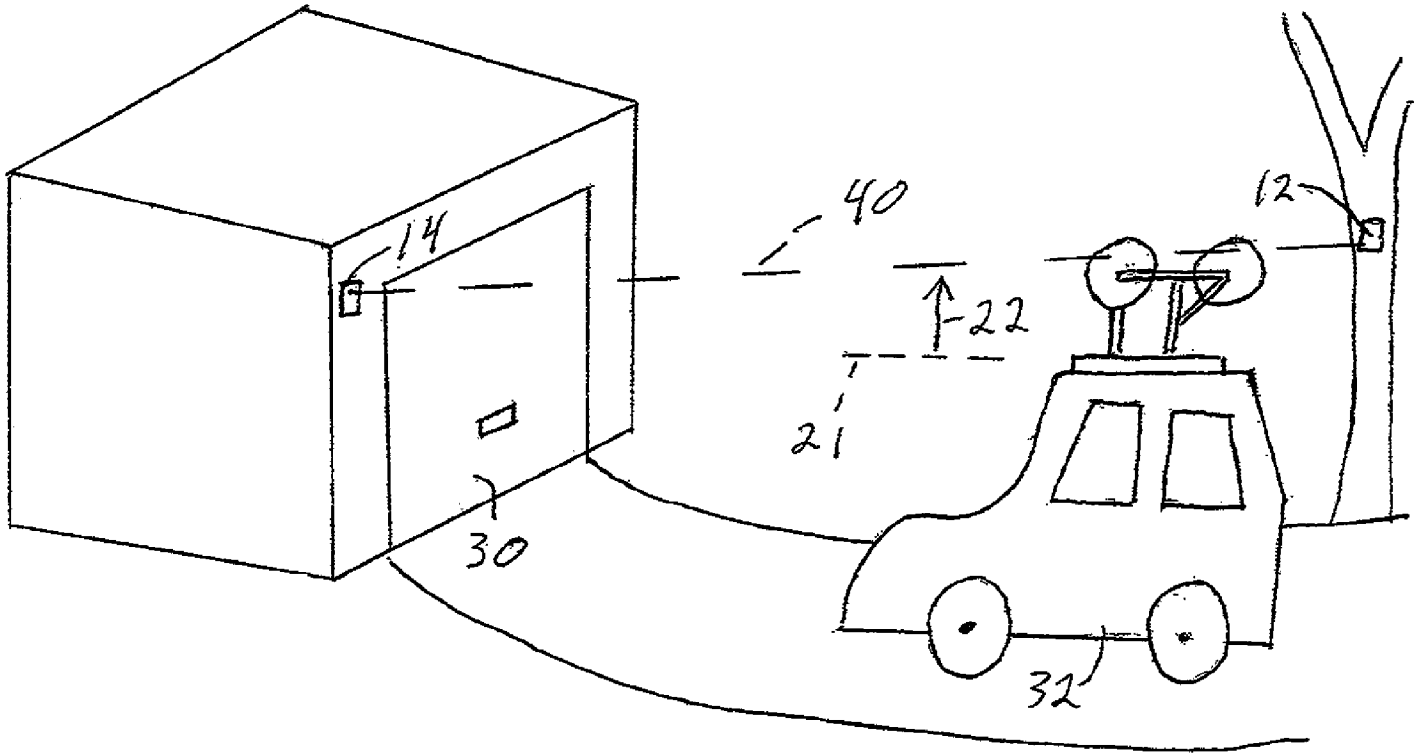
FIG. 2 is a schematic view of a vehicle in relationship to the preferred embodiment shown in FIG. 1.

One preferred embodiment of the control system of the invention is generally shown and referred to in FIG. 1 as system 10. System 10 preferably comprises a sender or source 12, a receiver or sensor 14, a means for communicating 16, a circuit breaker or interrupt 18, and an actuator 20. As shown in FIG. 2, source 12 and sensor 14 should be positioned and attached to objects so that the sensing zone 22 is located between source 12 and sensor 14. System 10 is designed to work in conjunction with known control systems for opening and closing a garage door 30. A typical control system utilizes a motorized device that draws the garage door up in response to an actuator, such as actuator 20 which, in turn, is triggered by a direct switch, typically located on a wall inside the garage, or a remote switch located on a remote control kept inside the vehicle. System 10 comprises an interrupt, otherwise referred to as a circuit breaker that interrupts the circuit, typically a 110 volt circuit, to prevent actuator 20 from initiating the motor 38 of the garage door control system from raising the door in response to a signal from a direct or remote switch. Interrupt 18 is thus positioned in the circuit before actuator 20 or between actuator 20 and the motor of the garage door control system.

Source 12, otherwise referred to as a sender, is preferably a light beam source that operates in connection with sensor 14, otherwise referred to as a receiver. Sensor 14 is preferably an "electric eye." The electric eye comprises a relay control system in which an error signal occurs when the beam is broken causing the controller within the electric eye to react, sending an electric signal from sensor 14 to interrupt 18 via the means for communicating 16. Communication means 16 preferably comprises electrical wiring appropriate for a 110 volt line, however, other similar means may be used depending on the garage door control system used.

Together source 12 and sensor 14 operate to detect and determine if an object has entered a predefined prohibited zone. Other similar detection systems can be used depending on the location and ambient circumstances of a given zone. Source 12 and sensor 14 are preferably positioned in a coaxial alignment, however, in situations in which coaxial alignment is not possible, other arrangements are possible using, but not limited to, non-focused beams and reflective devices.

In an alternative preferred embodiment, a motion detector is used to detect motion in the predefined zone. In this case, both a source 12 and a sensor are not necessary. For example, a narrow-beamed "motion sensor" device 14 could be used for the sensor, and set to aim straight out from or alongside and close to the garage at a certain height (e.g., above level 21). If any motion is detected in the zone covered by the motion sensor, this means that the height limit is exceeded and the motion sensor would turn off the opener in the same manner as described above. That way, there wouldn't need to be a detector mounted on a tree or other object spaced from but in a line of sight with the garage. Further, depending on the circumstances and the number of zones and parameters being monitored, such as a multiple sensing system, a combination of light source/detector devices and motion sensors may be used.

When the output from source 12 that is sensed by sensor 14 is broken or interrupted by an object that enters the prohibited zone (such as anything outside of an area a bit smaller than garage door 30), or when the motion detector detects motion within the prohibited zone, a signal is transmitted by the means for communicating from sensor 14 to interrupt 18. For example, as shown in FIG. 2, as automobile 32 enters the driveway, the bicycle fixed to the bike rack on top of automobile 32 enters zone 22 above car roofline 21, thereby crossing and breaking the path of the light beam 40. Once the light beam is broken (or motion is sensed), a signal is sent from sensor 14 to interrupt 18. This breaks the circuit between the actuator and the motor. The garage door thus cannot open until the opener system is (preferably affirmatively) reactivated by the user after the bicycle is removed from the top of the automobile. To reactivate system 10, the user can simply throw switch 36 provided at a convenient location to the user to reconnect the circuit. System 10 may also be constructed so that interrupt 18 only breaks the circuit for a limited period of time and then the circuit reactivates automatically after the prescribed period of time (e.g. 30 seconds).

System 10 may be set up, as described above, so that the relay interrupts the circuit so that the door does not open in response to the indoor (direct) switch or the remote (auto) switch. This embodiment of the system can be readily retrofitted to existing garage door control systems. Alternatively, the system may be set so that the relay interrupts the circuit only against the remote switch but not the direct switch.

System 10 may be battery-powered or powered by hard wiring the system into the electrical system of the building. If battery-powered, system 10 is preferably constructed so that the circuit is broken, and the garage door deactivated, if the battery wears down and unless and until the battery is replaced. System 10 may also additionally provide an audible and/or visible alarm signal when the light beam 40 is broken.

System 10 may be configured in a variety of ways including, but not limited to, using one sensor for one door, multiple sensors at different locations for one or more doors, or a single sensor for more than one door.

Although specific features of the invention are shown in some drawings and not others, this is for convenience only as the features may be combined in other manners in accordance with the invention. Other embodiments will occur to those skilled in the art and are in accordance with the claimed invention.

What is claimed is:

1. A garage door control system for a garage door that is located at an opening to a garage, in which the garage door is opened by a user-operated garage door opener system that includes a motor that opens the door, wherein the control system temporarily disables operation of the garage door opener system when a vehicle is about to enter the garage carrying an object that is temporarily being carried on a roof of the vehicle and that projects above the opening of the garage, the control system comprising:

an object sensor located at least in part proximate the garage door and at a height that is above the height of the roof of the vehicle, the object sensor thus sensing an object that is temporarily located on the roof of the vehicle approaching the garage and projecting higher than is safe to enter the garage without hitting an opened garage door or the garage proximate the garage opening, wherein the object sensor transmits a sense signal in response to the sensing of the object;

an interrupt, responsive to the sense signal, that automatically prevents the motor from opening the garage door when the interrupt receives the sense signal from the object sensor; and a user-operable switch that, when operated after the motor has been prevented by the interrupt from opening the door, allows the motor to operate again, so that the control system is reactivated by a user after the object is removed from the roof of the vehicle.

2. The garage door control system of claim 1 in which the interrupt comprises a timer that prevents the motor from opening the garage door for only a certain period of time after the interrupt receives the sense signal.

3. The garage door control system of claim 1 in which the object sensor comprises a sender and a receiver.

4. The garage door control system of claim 3 in which the receiver is located on the garage proximate the garage door, and at a height that is above the height of the vehicle without the object on it.

5. The garage door control system of claim 4 in which the sender is located remotely from the receiver and remotely from the garage, and at a height that is above the height of the vehicle without the object on it, to create a sense zone between the sender and receiver, such that a vehicle approaching the garage passes underneath the sense zone, but the vehicle does not enter the sense zone, so that the object sensor does not sense the vehicle but only senses an object carried on top of the vehicle.

* * * * *